US005439558A

United States Patent [19]

Bergmann et al.

[11] Patent Number: 5,439,558

[45] Date of Patent: Aug. 8, 1995

[54] PRINT SUBSTRATE

[75] Inventors: Werner Bergmann, Brüggen; Paul H. Dähling, Elsdorf-Esch, both of Germany

[73] Assignee: Stora Feldmuhle AG, Dusseldorf, Germany

[21] Appl. No.: 284,642

[22] PCT Filed: Mar. 10, 1993

[86] PCT No.: PCT/EP93/00540

§ 371 Date: Aug. 16, 1994

§ 102(e) Date: Aug. 16, 1994

[87] PCT Pub. No.: WO93/22500

PCT Pub. Date: Nov. 11, 1993

[30] Foreign Application Priority Data

Apr. 25, 1992 [DE] Germany ..... 42 13 746.2

[51] Int. Cl.[6] ..... D21H 19/54; D21H 19/40

[52] U.S. Cl. ..... 162/135; 428/342; 428/323; 428/511; 427/411

[58] Field of Search ..... 162/135, 136, 137, 181.8, 162/175, 206, 181; 106/400, 416, 424, 429, 210, 162; 427/411, 212, 395, 366; 428/323, 375, 380, 402, 403, 317.5, 340, 341, 342

[56] References Cited

U.S. PATENT DOCUMENTS 3,779,800 12/1973 Heiser ..... 117/155 UA
4,298,652 11/1981 Suzuki et al. ..... 428/323
4,370,389 1/1983 Ogura et al. ..... 428/511
5,093,159 3/1992 Fernandez et al. ..... 427/342
5,120,365 6/1992 Kogler ..... 106/415
5,152,835 10/1992 Nemeh ..... 106/437
5,314,753 5/1994 Bergmann ..... 428/511

FOREIGN PATENT DOCUMENTS 9006399 6/1990 WIPO ..... D21H 19/14

*Primary Examiner*—W. Gary Jones
*Assistant Examiner*—Jose A. Fortuna
*Attorney, Agent, or Firm*—Cohen, Pontani, Lieberman, Pavane

[57] ABSTRACT

A print substrate, in particular paper, has a coat on one or both sides, which contains ungelatinized starch granules and kaolin as coating pigment and possibly one or more additional mineral pigments and binder and wherein the content of the starch granules is 2 to 25% by weight with respect to the total coating pigment; the binder proportion—with respect to the total pigment—is less than 12% by weight calculated as parts by weight when dry; the gloss of the coat after calendaring is greater than 40% as measured at an angle of 75° according to Lehmann; the mineral coating pigment comprises at least 60% by weight of kaolin and the mineral pigment component and starch granules make up the remainder to 100% by weight of the total coating pigment.

12 Claims, No Drawings

PRINT SUBSTRATE

FIELD OF THE INVENTION

The present invention is directed to print substrates, in particular paper, having a coat on one or both sides which contains ungelatinized starch granules as coating pigment in addition to mineral pigment and binder.

BACKGROUND OF THE INVENTION

A print substrate of the type mentioned above is described in DE-A-38 41 199. This is a matt-coated printing paper for offset printing or rotogravure printing whose gloss, according to the examples contained in that text, ranges from 15% to 38% as measured at an angle of 75° according to Lehmann. The proportion of ungelatinized starch granules in the known printing paper ranges from 10 to 65 percent by weight with respect to the total solids content of the coat. In addition to the starch granules, calcium carbonate is also contained as mineral pigment, preferably in an amount ranging from 25 to 70 percent by weight with respect to the solids content of the coat. Although a proportion of other mineral pigments—apart from calcium carbonate—amounting to 63 percent by weight with reference to the total coating pigment can be calculated from this data based on a binder proportion of 5 percent by weight, it is expressly stated that the maximum proportion of other pigments, e.g. coating china clay or kaolin, is advisably not more than 15 percent by weight with reference to the solids content of the coat.

Ungelatinized starch granules were also already suggested in DE-A-25 01 684 for the production of embossable, printable and washable raw or base wallpaper. According to this suggestion, 10 to 100 percent by weight of the total pigment content is added in the form of ungelatinized starch so that, according to the stricter teaching, the presence of inorganic pigment can also be dispensed with. To achieve sufficient washability, the binder proportion is 15 to 100 percent by weight, preferably 50 to 60 percent by weight, with respect to the total pigment content, where it is suggested that calcium silicate be added as mineral pigment.

DE-B-12 21 893 describes the production of a coated printing paper in which starch is rendered partially cold-soluble by mechanical treatment in a pug mill so that when drying is effected subsequent to the coating process it will still be dissolved by the evaporating water of the coating compound and, in dissolved or gelatinized form, contributes, as binder, to the fixation of the pigments, e.g., chalk, in a manner known per se. The produced papers have a confirmed high gloss, but this older suggestion is not capable of fully satisfying the requirements for modern printing paper.

DE-A-26 05 575 is directed to a coated paper, in particular for paper currency and security documents, whose surface is treated with a mixture of latex and ungelatinized starch granules as filler. Conventional dispersing agents, natural binders and common filler materials are mentioned as other additives, although no specific quantities are mentioned. The amount of ungelatinized starch added is in the range of 0.25 to 25 parts by weight for 1 part by weight of the flexible polymers consisting of latex. The produced paper has a matt appearance and should not be excessively calendered so as not to impair the properties of the paper such as printability, storage stability and resistance to soaking and changes in moisture content.

It will be gathered from the references discussed above that ungelatinized starch granules have previously been mentioned in relation to the production of special papers such as bank note paper, embossed wallpapers and for matt printing paper. However, for the substantially more important field of printing paper with standard glossiness as used, for example, as print substrates for illustrated magazines, mail order catalogs, advertisement brochures, etc., where these print substrates are usually coated on both sides, ungelatinized starch granules have not previously been mentioned as additives for the coat absorbing the printing ink. However, there is an urgent need to improve the printability of such print substrates, in particular lightweight coated papers, so-called LWC paper, particularly also because of the need for a steady reduction in the grammage of raw or base paper and in the coat weight to be applied in order to lower the cost of this paper. Thus, the largest possible printable surface must be provided while reducing the weight of the paper. Since, as is well known, appearance of the printed image, particularly in paper to be printed by rotogravure printing, substantially depends on the surface of the paper when this paper is coated, i.e. on the smoothness and evenness of the coat, this paper must be calendered, usually by using so-called supercalendering. In spite of the most careful selection of the raw components to be used, in particular the coating pigments and binders, the strict requirements with regard to printing quality in rotogravure papers can not always be met. More particularly, the problem consists in further reducing the number of missing dots. By missing dots is meant unprinted defective locations which occur due to slight unevenness in the surface of the paper because the web to be printed does not accurately contact the rotogravure form, so that the printing ink located in the cells of the rotogravure form is not sucked out of these cells and voids occur in the printed image due to the absence of printing ink.

SUMMARY AND DETAILED DESCRIPTION OF THE INVENTION

The present invention has the object of providing a coated paper, in particular for use in intaglio or rotogravure printing, in which the printability is improved by better coverage of the surface of the uncoated print substrate, e.g. a coating base paper, with the applied coat and in which there is an appreciable reduction in the occurrence of missing dots.

It has now been found that the proposed object is met in print substrates, in particular paper, having a coat on one or both sides which contains ungelatinized starch granules and kaolin as coating pigment and possibly one or more additional mineral pigments and binder; or a print substrate, particularly paper, having a coat on one or both sides which contains ungelatinized starch granules and calcium carbonate as coating pigment in addition to one or more additional mineral pigments as well as binder. For this purpose, it was necessary to adapt the added amount of starch granules to the type and quantity of mineral pigments present in the coat. Since kaolin was also to be taken into account as a determining mineral pigment component, the teaching disclosed by DE-A-38 41 199, which restricts the content of coating kaolin to a maximum of 15 percent by weight with respect to the solids content of the coat, could not provide a starting point for this purpose. Insofar as kaolin is used as a constituent of the coating pigment in an amount of at least 60 percent by weight with respect to the total coating pigment proportion, it is possible to use as much as 25 percent by weight of starch granules. On the other hand, the amount of starch granules added to the coat is reduced to less than the added quantity suggested in DE-A-38 41 199 when the mineral coat pigment contains 40 to 65 percent by weight calcium carbonate and the remainder of the mineral coating pigment is made up of kaolin, titanium dioxide, talc or satin white.

Therefore, according to a first embodiment, in a print substrate, particularly paper, having a coat on one or both sides which contains ungelatinized starch granules and kaolin as coating pigments and possibly one or more additional mineral pigments in addition to binder, the invention provides that

- the content of starch granules is 2 to 25 percent by weight with respect to the total coating pigment,
- the binder proportion—with respect to the total coating pigment—is less than 12 percent by weight calculated as parts by weight when dry,
- the gloss of the coat after calendering is greater than 40% as measured at an angle of 75° according to Lehmann,
- the mineral coating pigment comprises at least 60 percent by weight of kaolin and the mineral pigment component and starch granules make up the remainder to 100 percent by weight of the total coating pigment.

The proportion of kaolin in the coating pigment in this embodiment is preferably more than 90 percent by weight with respect to the total coating pigment. However, up to 25 percent by weight of the mineral coating pigment component with respect to the total coating pigment can be composed of calcium carbonate, titanium dioxide, talc or a mixture of these substances. These coating pigments are used, for example, to improve whiteness and opacity (calcium carbonate/-titanium dioxide) or to improve the smoothness when adding talc.

When the determining component in the mineral coating pigment is calcium carbonate rather than kaolin, according to a second embodiment of the present invention, in a print substrate, particularly paper, having a coat on one or both sides which contains ungelatinized starch granules and calcium carbonate as coating pigment in addition to one or more additional mineral pigments as well as binder, the invention provides that

- the content of starch granules is 2 to less than 10 percent by weight with respect to the total coating pigment,
- the binder proportion—with respect to the total coating pigment—is less than 12 percent by weight calculated as parts by weight when dry,
- the gloss of the coat after calendering is greater than 40% as measured at an angle of 75° according to Lehmann,
- the mineral coating pigment comprises 40 to 65 percent by weight of calcium carbonate and the remainder of the mineral coating pigment is made up of kaolin, titanium dioxide, satin white, talc or a mixture of these pigments, wherein the mineral pigment components and starch granules make up the remaining proportion to 100 percent by weight of the total coating pigment.

Another form of the embodiment indicated above provides for a proportion of 20 to 50 percent by weight of talc with respect to the total coating pigment proportion.

According to the invention, starch granules with an average granule diameter of 1 to 30 μm are used; however, an average granule diameter of 2 to 9 μm is particularly preferred. In order to ensure that the starch granules will not form a paste, starches which are preferably chemically modified, e.g. etherified or esterified starches, are used. Starch granules from potato, corn, wheat, rye, rice or tapioca starch or a mixture of these starches can be used. The content of starch granules with respect to the total coating pigment proportion is preferably less than 10 percent by weight, preferably from 4 to 7 percent by weight, also when the essential component of the mineral coating pigment proportion is kaolin. There is no noticeable improvement in printability with quantities of less than 2 percent by weight.

Although the present invention is not limited to certain print substrates and can also be applied, for example, to cardboards, it has special importance for the domain of lightweight papers, so-called LWC papers. It must be considered as surprising that with the normally small coat application weights of kaolin and calcium carbonate used here as chief components of the mineral pigment proportion considerable improvement in printability can be achieved by the addition of small quantities of ungelatinized starch granules. In a print substrate produced by using a coated base paper of 30 to 60 g/m$^2$, the invention preferably provides a coat on both sides with a grammage of 4 to 12 g/m$^2$ per side. In a particularly preferred embodiment of the invention, the print substrate comprises a coated base paper with a grammage of 34 to 40 g/m$^2$ and the coat containing the starch granules is applied in the amount of 6 to 8 g/m$^2$ per side.

According to a particularly preferred embodiment of the print substrate according to the invention which is provided for use as rotogravure printing paper, the binder proportion is 4 to 7 percent by weight.

Binders used in the present invention are the usual plastics dispersions and latices, although a small amount of natural binder, e.g. a starch solution, can also be included.

Whereas in LWC papers only one coat is applied per side, a so-called pre-coat or primer can be applied in addition to the coat containing the starch granules and absorbing the priming ink in the manufacture of other print substrates. Such print substrates having a pre-coat are also included within the scope of the present invention.

The advantages of the invention are clearly discernable from visual inspection of a print substrate, according to the present invention, which is printed by rotogravure. In comparison tests between a standard LWC paper—Comparison Example 2 below—produced from a coated base paper of 46 g/m$^2$ and provided with a coat of 10 g/m$^2$ per side on both sides, where the coating pigment proportion comprised 80 percent by weight of kaolin, 10 percent by weight calcium carbonate, 5 percent by weight of talc and 5 percent by weight of titanium dioxide, and the same paper in which 9 percent by weight of kaolin was substituted with starch granules—Example 2—the printed image of the paper produced according to the present invention showed a distinctly improved equilibrium of the impression, particularly in the half-tone areas. This perception received by visual inspection is confirmed by the test results, indicated below, using the helio test and Kajaani formation test on unprinted papers.

The helio testing method is described briefly as follows: A rotogravure printing form which is filled with printing ink and has cells of increasing depth is rolled over a test strip at constant contact pressure. The measured length on the test strip before 20 missing dots occur, starting from the darker end (deep cells) of the test strip, is indicated in millimeters. If 20 missing dots do not occur along the entire length of the strip measuring 110 mm, the number of missing dots is indicated by 110 mm. The formation test was performed with the Kajaani Formation Analyzer (Kajaani Electronics Ltd. ).

The following examples serve to explain the invention more fully:

Comparison Example 1

Coated base paper with a grammage of 46 g/m$^2$ was provided with a coat of 10 g/m$^2$ per side. The coat contains 5 percent by weight—with respect to the coating pigment—of a commercial rotogravure binder based on acrylic acid ester. The coating pigment comprised 60 percent by weight of calcium carbonate and 40 percent by weight of talc. After drying of the coat, the paper was supercalendered.

Comparison Example 2

A coat with a pigment proportion of 80 percent by weight of kaolin, 10 percent by weight of calcium carbonate, 5 percent by weight of talc and 5 percent by weight of titanium dioxide was applied. Otherwise, this example corresponds to comparison example 1.

Example 1

The coat applied in this example had the following total pigment composition:

55 wt.-% calcium carbonate 40 wt.-% talc 5 wt.-% corn starch granules with an average granule diameter of 20 μm.

Otherwise, this example corresponds to Comparison Example 1.

Example 2

As in comparison example 2, a print substrate was produced in which 9 percent by weight of kaolin were substituted with starch granules from a fractionated wheat starch with an average granule diameter of 5 μm.

The following table shows that the papers according to the invention have fewer missing dots accompanied by a sufficient gloss and further that the coverage of the paper surface is substantially improved by 9 percent by weight of starch granules.

TABLE

| | adjusted calender pressure (KN/m) | gloss 75° | formation test | helio test |
|---|---|---|---|---|
| Comparison Example 1 | 190 | 48 | — | 28 |
| Comparison Example 2 | 190 | 52 | 93.1 | 65 |
| Example 1 | 190 | 50 | — | 76 |
| Example 2 | 190 | 45 | 105.3 | 98 |

What is claimed is:

1. A print substrate of paper or cardboard comprising:

a coat on one or both sides containing ungelatinized starch granules and kaolin as coating pigment; and, optionally, one or more additional mineral pigments; and a binder, and wherein the content of the ungelatinized starch granules is 2 to 25 percent by weight with respect to the total coating pigment;

the binder proportion—with respect to the total coating pigment is less than 12 percent by weight calculated as parts by weight when dry;

the gloss of the coat after calendering is greater than 40% as measured at an angle of 75° according to Lehmann;

the mineral coating pigment comprises at least 60 percent by weight of kaolin and the mineral pigment component and starch granules make up the remainder to 100 percent by weight of the total coating pigment.

2. The print substrate according to claim 1, wherein the mineral proportion of the coating pigment is greater than 90 percent by weight of kaolin.

3. The print substrate according to claim 1, wherein the mineral coating pigment comprises—with respect to the total coating pigment—up to 25 percent by weight of calcium carbonate, titanium dioxide, talc or a mixture thereof.

4. The print substrate according to claim 1, wherein the starch granules have an average granule diameter of 1 to 30 μm.

5. The print substrate according to claim 1, wherein the starch granules have an average granule diameter of 2 to 9 μm.

6. The print substrate according to claim 1, wherein the coated paper has a grammage of 30 to 60 g/m$^2$ and wherein the coat containing the starch granules has a grammage of 4 to 12 g/m$^2$ per side.

7. The print substrate according to claim 6, wherein the coated paper has a grammage of 34 to 40 g/m$^2$ and the coat containing the starch granules has a grammage of 6 to 8 g/m$^2$ per side.

8. A print substrate of paper or cardboard, comprising a coat on one or both sides containing ungelatinized starch granules and calcium carbonate as coating pigment in addition to one or more additional mineral pigments as well as binder, and wherein the content of ungelatinized starch granules is 2 to less than 10 percent by weight with respect to the total coating pigment;

the binder proportion—with respect to the total coating pigment—is less than 12 percent by weight calculated as parts by weight when dry;

the gloss of the coat after calendering is greater than 40% as measured at an angle of 75° according to Lehmann;

the mineral coating pigment comprises 40 to 65 percent by weight of calcium carbonate and the remainder of the mineral coating pigment is made up of kaolin, titanium dioxide, satin white, talc or a mixture of these pigments, wherein the mineral pigment components and starch granules make up the remaining proportion to 100 percent by weight of the total coating pigment.

9. The print substrate according to claim 8, wherein the talc makes up a proportion of 20 to 50 percent by weight with respect to the total coating pigment.

10. The print substrate according to claim 8, wherein the starch granules have an average granule diameter of 1 to 30 μm.

11. The print substrate according to claim 8, wherein the starch granules have an average granule diameter of 2 to 9 μm.

12. The print substrate according to claim 8, wherein the coated paper has a grammage of 30 to 60 $g/m^2$ and wherein the coat containing the starch granules has a grammage of 4 to 12 $g/m^2$ per side.

* * * * *